US008096644B2

(12) United States Patent
Murakami et al.

(10) Patent No.: US 8,096,644 B2
(45) Date of Patent: Jan. 17, 2012

(54) LIQUID EJECTION HEAD AND LIQUID EJECTION METHOD

(75) Inventors: Shuichi Murakami, Kawasaki (JP); Akihiro Yamanaka, Yokohama (JP); Yasunori Takei, Tokyo (JP); Ryoji Oohashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 385 days.

(21) Appl. No.: 12/051,762

(22) Filed: Mar. 19, 2008

(65) Prior Publication Data

US 2008/0231664 A1 Sep. 25, 2008

(30) Foreign Application Priority Data

Mar. 23, 2007 (JP) ..... 2007-077543

(51) Int. Cl.
*B41J 2/05* (2006.01)
*B41J 2/14* (2006.01)
*B41J 2/16* (2006.01)

(52) U.S. Cl. ..... 347/65; 347/47

(58) Field of Classification Search ..... 347/56, 347/62

See application file for complete search history.

(56) References Cited

U.S. PATENT DOCUMENTS

| | | | | |
|---|---|---|---|---|
| 4,967,208 | A * | 10/1990 | Childers | 347/56 |
| 6,155,673 | A | 12/2000 | Nakajima et al. | |
| 6,354,698 | B1 * | 3/2002 | Tachihara et al. | 347/56 |
| 6,443,564 | B1 * | 9/2002 | Keil et al. | 347/65 |
| 6,447,104 | B1 * | 9/2002 | Keil et al. | 347/65 |
| 6,652,079 | B2 * | 11/2003 | Tsuchii et al. | 347/65 |

FOREIGN PATENT DOCUMENTS

JP 2002-321369 11/2002

* cited by examiner

*Primary Examiner* — Matthew Luu
*Assistant Examiner* — Lisa M Solomon
(74) *Attorney, Agent, or Firm* — Canon USA Inc IP Division

(57) ABSTRACT

A print head, which ejects ink by using a method whereby a bubble generated by a heat generating element communicates with the air, and for which the occurrence of cavitation is deterred and the durability is improved, is provided. According to the print head, a bubble grows until the maximum volume is attained, and then, at a volume reduction step, communicates with the air. As a result, a liquid in a bubble generation chamber is ejected. An ejection port and the heat generating element are arranged so that the center of the ejection port is shifted away from the center of the heat generating element in a direction leading from an ink supply port to the ejection port.

2 Claims, 12 Drawing Sheets

LIQUID EJECTION HEAD AND LIQUID EJECTION METHOD

BACKGROUND OF THE INVENTION

1. Field of the Invention

The present invention relates to a liquid ejection head which generates and provides energy to eject a liquid through ejection ports in the liquid ejection head, and to a liquid ejection method for ejecting a liquid from the liquid ejection head.

2. Description of the Related Arts

Presently, a method using a heat generating element to eject ink is widely utilized for inkjet printing apparatuses. According to this method, ink is supplied along flow paths to a common liquid chamber, and when this chamber is filled, an electric signal is applied to a heat generating element to generate heat. The heat generating element is arranged in a bubble generation chamber to serve as an energy application chamber, thereby initiating the production of heat. Thereafter, ink around the heat generating element in the bubble generation chamber is heated rapidly to the boiling point, i.e., is boiled, and forms a bubble on the heat generating element. As a consequence of this phase change, an increased pressure generated as a result of production of the bubble, imparts to the ink in the bubble generation chamber sufficient kinetic energy to eject ink outward and to eject an ink droplet to the exterior, through an ejection port. Thus, thermal energy applied to the ink by the heat generating element is converted into kinetic energy, which in turn causes an ink droplet to be ejected. As a consequence, as ink droplets are ejected through ejection ports which are in communication with bubble generation chambers, the printing is performed to a printing medium. Furthermore, since this type of printing apparatus is simply structured, one of its more notable features is that the ink ejection arrangement provides easy means for the integration of ink flow paths, for example.

When this ink ejection method is utilized, a bubble generated by a heat generating element grows until ink is ejected. Thereafter, heat retained by the heat generating element and ink in the vicinity of the heat generating element is dispersed to reduce the volume of the bubble. Then, for disappearance of the bubble, collapse of the bubble is caused by ink in the bubble generation chamber. This collapse of the bubble may cause surface damage within the bubble generation chamber. That is, surface cavitation may occur, and consequently, with the driving of the heat generating element, may damage the surface of the heat generating element. Therefore, as a countermeasure, to maintain durability and to ensure availability for practical use is not impaired, a protective layer, such as one composed of Ta, is deposited on the surface of the heat generating element.

As another countermeasure for avoiding cavitation damage, proposed, for example, is a print head disclosed in Japanese Patent Laid-Open No. 2002-321369. According to this proposal, a print head is disposed wherein the center line of a heat generating element is offset relative to the center line of an ink flow path leading to a bubble generation chamber. Since, in this manner, the center line of the heat generating element is shifted away from the center line of the ink flow path. Thus, it is prevented that a location at which bubbles are disappeared is concentrated at a single location. Therefore, the locations at which cavitation may occur can be scattered. This also prevents disappearing bubbles at locations around the heat generating element. As a result, since the location at which a bubble may disappear will not correspond to a heat generating element, cavitation occurring at locations around the heat generating element surface is prevented, and damage to the heat generating element is avoided.

Furthermore, according to an ink ejection method disclosed in U.S. Pat. No. 6,155,673, when a bubble has grown and ink ejection is imminent, the bubble is permitted to communicate with external air. According to this ink ejection method, since a path from the bubble to the exterior is opened, the internal bubble pressure is vented externally, abruptly dropping until nearly equivalent to that of the air. Thus, the bubble is released to the air without collapsing by ink, and ink is supplied, in an amount of ink equivalent to that ejected, to refill the bubble generation chamber. Therefore, since it is inhibited that the bubble remains in the bubble generation chamber in this manner, cavitation occurring is inhibited, and damage to the surface of the heat generating element can be prevented.

Moreover, another ink ejection method whereby a bubble is permitted to communicate with external air, as in U.S. Pat. No. 6,155,673, is proposed in U.S. Pat. No. 6,354,698. According to this method, first, a bubble is permitted to grow until a maximum bubble volume is reached while ink is being ejected, and then, at the succeeding step of the bubble volume is reduced, it is permitted the bubble to communicate with external air. When this method is used to perform ink ejection, not only cavitation occurring is inhibited, as with the preceding method, but also, after ink has been ejected, the liquid surface at the ejection port recedes in a direction opposite that in which ink is ejected. Thus, ink that may form a satellite droplet is easily separated from the main ejected droplet, and absorbed by the surface of liquid at the ejection port. As a result, the occurrence of mist is prevented, and high quality printing enabled.

When the liquid ejection method of an air communication type, as proposed in U.S. Pat. No. 6,155,673 or U.S. Pat. No. 6,354,698, is used, occurrence of cavitation is inhibited. The occurrence of cavitation, however, is not fully prevented by using these liquid ejection methods, and depending on the case, cavitation may still appear.

While referring to FIGS. 12A to 12F, an explanation will now be given for an example ink ejection process performed by an ink ejection method, as proposed in U.S. Pat. No. 6,354,698, whereby at first, a bubble grows, attaining a maximum bubble volume while ink is being ejected, and then, at the succeeding step for reduction of the bubble volume, the bubble is permitted to communicate with external air.

As shown in FIG. 12A, when based on a print signal, for example, a current is supplied to a heat generating element and a bubble is thereby generated in an ink flow path, then the bubble abruptly inflates and grows rapidly. Then, as shown in FIG. 12B, in response to a pressure buildup, the result of the bubble generation, ink is ejected through an ejection port. While the ink ejection process is carried out, simultaneously, a maximum bubble volume is reached, and thereafter, as shown in FIG. 12C, the volume of the bubble is reduced. At nearly the same time, inside the ejection port, formation of a meniscus is begun. Since the amount of ink in a bubble generation chamber is reduced when ink is ejected, as shown in FIG. 12D, the meniscus moves inward, toward the heat generating element. Since the meniscus travels at a higher speed than that at which bubble deflation occurs, as shown in FIGS. 12E and 12F, the meniscus catches up with the still inflated bubble, which can then communicate with air below the ejection port. At this time, communication between the bubble and the air occurs at a location near the center of the heat generating element.

In a case such as shown in FIG. 12D, where the meniscus is moving toward the heat generating element, the surface of liquid traveling toward the heat generating element pushes against and compresses both the ink situated between the meniscus and the heat generating element and the bubble portion. Therefore, while being compressed, substantially toward the center of the heat generating element, the bubble is bent and the portion opposite the center of the heat generating element is formed into an annular shape. Sequentially, thereafter, as shown in FIG. 12E, the bubble having the annular portion is divided into a portion nearer the rear wall of the heat generation chamber and a portion nearer the ink supply port. Since the divided bubble of the portion nearer the ink supply port which has the larger volume is in communication with air, the internal bubble pressure is reduced to that of the atmosphere. Then, new ink is supplied to the bubble generation chamber, the bubble generation chamber is refilled, the bubble portion is in communication with the air, and the bubble disappears, as shown in FIG. 12F, while the communication state is maintained. However, since no bubble to air communication is established for the bubble portion near the rear wall of the bubble generation chamber, that bubble portion remains in the bubble generation chamber and may cause cavitation. As described above, it was found that when bubble to air communication is established near the center of the heat generating element, the bubble tends to be divided, and since a bubble portion for which bubble to air communication is not established is not removed, cavitation may occur. Further, since cavitation may occur, the protective layer formed on the surface of the heat generating element would be damaged, and the durability of the heat generating element deteriorated.

In addition, a behavior of phenomenon is changed depending on the height of an ink flow path formed in a bubble generation chamber, the phenomenon is that once a maximum bubble volume is reached, and then, when the volume of the bubble is reduced, bubble to air communication is established. The greater the height of an ink flow path in a heat generation chamber, the smaller the difference is obtained between the respective speeds at which a meniscus travels after ink is ejected and at which a bubble deflates. Therefore, the period required to establish bubble to air communication is extended. Thus, the successful accomplishment of this event is delayed. The establishing bubble to air communication is carried out with the compression and deflation state of the bubble, in this case, is more advanced. As a result, bubble division tends to occur more frequently, and the possibility is greater that a bubble portion will remain in a bubble generation chamber and cause cavitation.

SUMMARY OF THE INVENTION

The present invention is directed to an ink ejection print head and an ink ejection method whereby, for ink ejection, bubble to external air communication can readily be established for a bubble generated by a heat generating element, and for which cavitation occurrence is reduced and durability is improved.

According to a first aspect of the present invention, a liquid ejection head includes an energy application chamber configured to receive a liquid from a liquid supply port and to communicate with an ejection port to eject the liquid; and a heat generating element arranged in the energy application chamber opposite the ejection port and configured to generate thermal energy to be used for ejecting the liquid. The liquid is ejected by generating a bubble by the thermal energy, wherein the bubble grows till the maximum volume is attained, and then when a volume reduction step begins, the bubble communicates with the air for the first time. The ejection port and the heat generating element are arranged so that the center of the ejection port is shifted away from the center of the heat generating element in a direction in which the liquid is supplied to the energy application chamber. At least a part of the ejection port is located outside an effective bubbling area of the heat generating element that contributes to generation of the bubble. A distance from a wall of the energy application chamber at the end of the direction to an edge of the effective bubbling area of the heat generating element that is on the side farther from the liquid supply port is 3 μm or greater.

According to a second aspect of the present invention, a liquid ejection method includes driving a heat generating element to generate thermal energy; applying the thermal energy to a liquid supplied through a liquid supply port and stored in an energy generation chamber; and generating a bubble by applying heat using the heat generating element, exerting kinetic energy on the liquid under bubble pressure from the bubble, and ejecting the liquid from an ejection port. At first, the bubble grows to attain the maximum volume, and then, at a volume reduction step, the bubble communicates with the air for the first time, so that the liquid in the energy application chamber is ejected. The heat generating element, the center of which is shifted from the center of the ejection port in a direction opposite to the liquid supply port, heats the liquid to generate the bubble. A liquid surface moved from the ejection port to inside the energy application chamber contacts the bubble so that the bubble communicates with the air. The bubble and the air communicate with each other at a location offset from the center of the heat generating element toward the liquid supply port.

According to the present invention, when a liquid is ejected by a liquid ejection head, retention of a bubble, or a bubble portion, in an energy application chamber is prevented, and cavitation occurrence is impeded. As a result, durability of the liquid ejection head can be improved.

Further features of the present invention will become apparent from the following description of exemplary embodiments (with reference to the attached drawings).

DESCRIPTION OF THE EMBODIMENTS

First Embodiment

A first embodiment of the present invention will now be described while referring to the accompanying drawings. It should be noted that the sizes and numerical values employed in this and the following individual embodiments are merely examples, and that neither size nor value limitations are intended.

Figure 1:
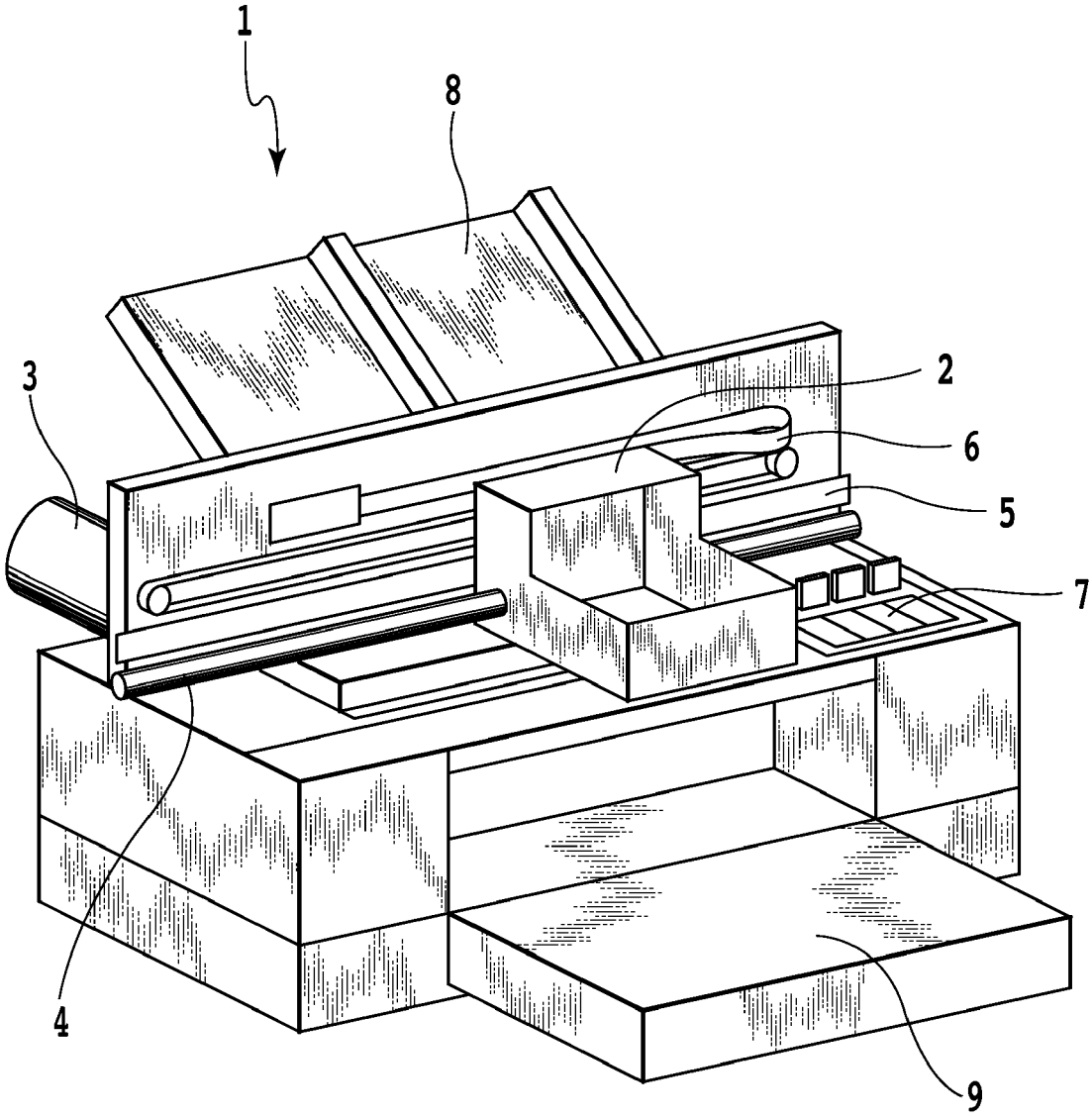
FIG. 1 is a perspective view of an inkjet printing apparatus that comprises a print head according to a first embodiment of the present invention.

FIG. 1 is a perspective view of an inkjet printing apparatus 1 according to the present embodiment. The inkjet printing apparatus 1 of this embodiment includes a carriage 2, upon which is mounted an inkjet head cartridge (not shown). The carriage 2 is reciprocally moved in the main scan direction by a carriage drive motor 3 and a drive force transmission mechanism 4, which conveys a drive force produced by the carriage drive motor 3. The inkjet printing apparatus 1 also includes an optical position sensor 5, which reads the position of the carriage 2. The inkjet printing apparatus 1 includes a flexible cable 6, which transmits an electrical signal from a controller (not shown) to the inkjet head cartridge. Furthermore, the inkjet printing apparatus 1 includes a recovery unit 7, which performs a recovery process for a print head mounted in the inkjet head cartridge. In this embodiment, to enable color printing, sufficient additional space is provided to accommodate an inkjet head cartridge arrangement that holds a plurality of detachable ink tanks.

Furthermore, a sheet feeding tray 8, on which printing media are stacked and stored, and a sheet discharging tray 9 are provided for the inkjet printing apparatus 1. The printing media stored on the sheet feeding tray 8 are individually conveyed from the sheet feeding tray 8 to the sheet discharging tray 9 via a conveying mechanism (not shown) provided inside the inkjet printing apparatus 1. While a printing medium is being conveyed through the interior of the inkjet printing apparatus 1, image printing of the printing medium is performed.

During printing, the carriage 2 included in the inkjet printing apparatus 1 having this arrangement is moved in the main scanning direction, perpendicular to the direction in which the printing medium is conveyed (the sub-scanning direction). While printing in the main scanning direction is being performed for a printing medium, the width of the area printed corresponds to the range within which the ejection ports (nozzles) of the inkjet printing head are arranged. Periodically, each time printing performed during a main scanning direction scan is completed, the printing medium is conveyed a predetermined distance in the sub-scanning direction.

Figure 2:
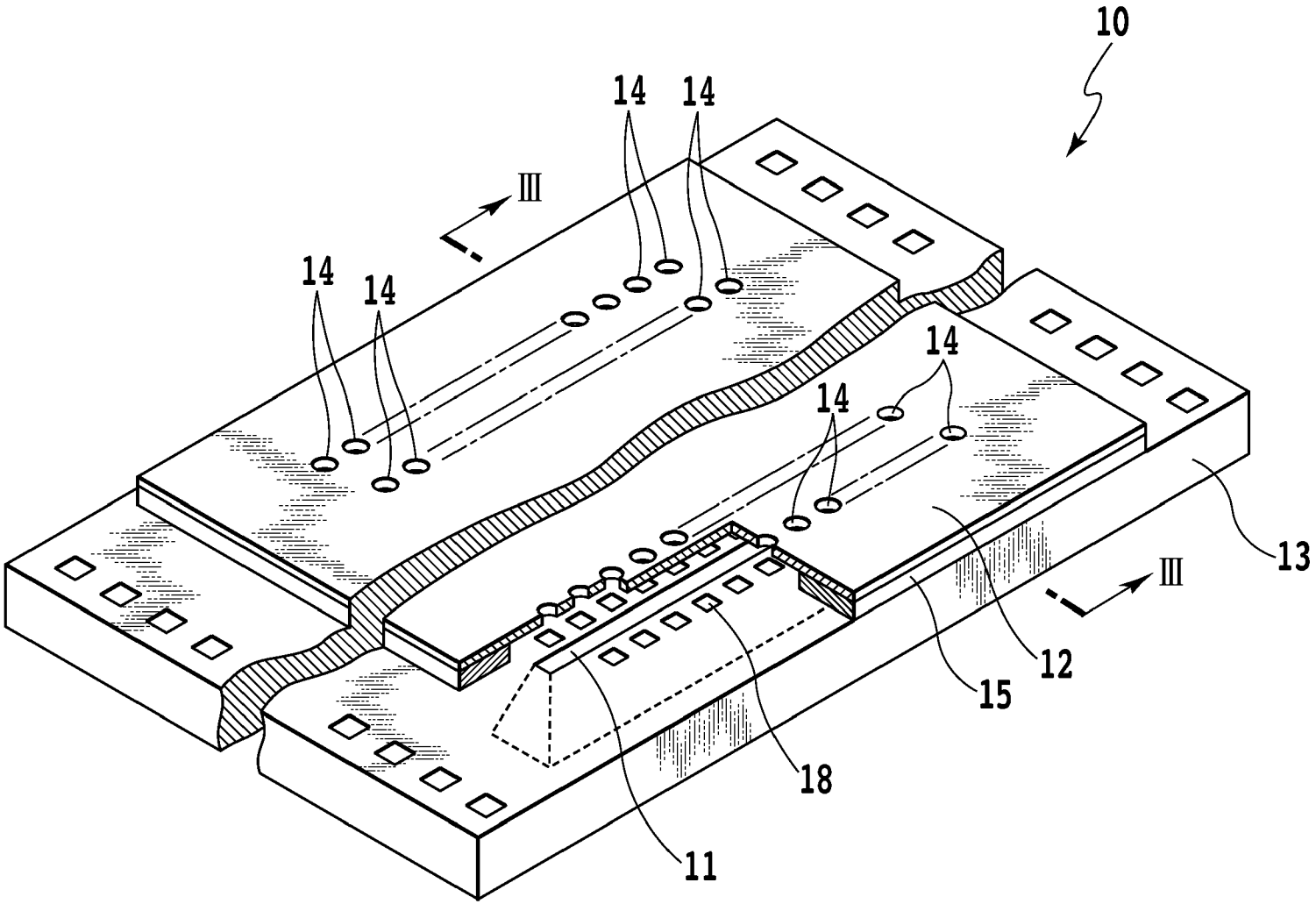
FIG. 2 is a partially cut-away perspective view of the print head according to the first embodiment of the present invention.
Figure 3:
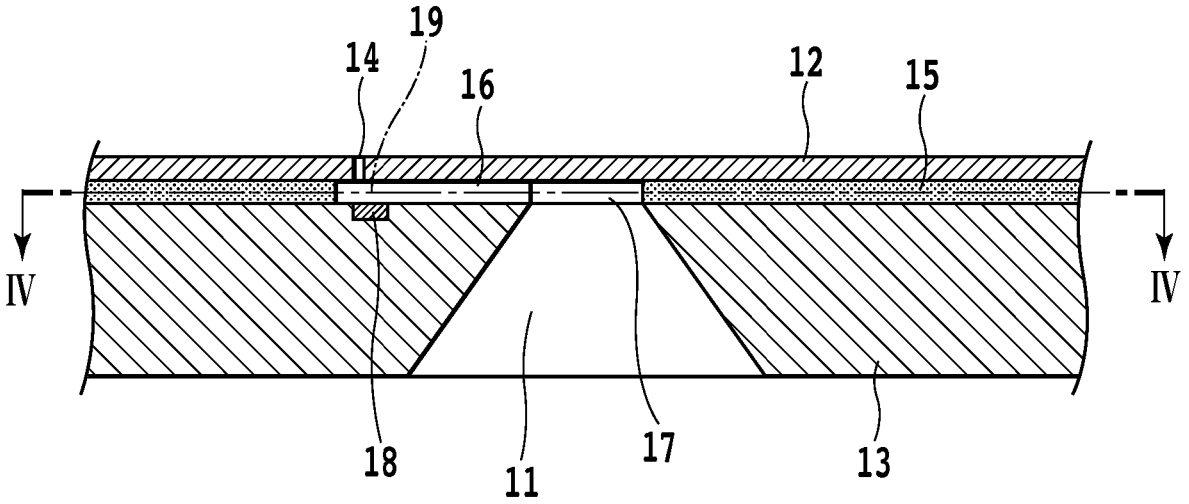
FIG. 3 is a cross sectional view of the print head taken along a line III-III in FIG. 2.

A print head (a liquid ejection head) 10 in this embodiment will now be explained while referring to the drawings. FIG. 2 is a partially cut-away perspective view of the print head 10, which is provided for an inkjet head cartridge to be mounted on the inkjet printing apparatus shown in FIG. 1, and FIG. 3 is a cross sectional view of one part, taken along a line III-III in FIG. 2.

The print head 10 is formed by bonding an orifice plate 12 to a substrate 13, while a flow path formation member 15 is positioned between them. The print head 10 also includes an ink supply port (a liquid supply port) 11 to which ink is to be supplied.

The ink supply port 11 is formed so that the ink supply port 11 penetrates through the substrate 13. In this embodiment, the opening width of the ink supply port 11 is reduced from the reverse face of the substrate 13 to the obverse face, i.e., from the face on the upstream side of the ink flow path to the face on which the orifice plate 12 is arranged. In this embodiment, the substrate 13 is made of Si; however, the substrate 13 may be formed of glass, ceramics, plastic or metal. That is, the choice of materials is not especially limited, so long as the substrate 13 becomes part of the flow path formation member, and serves as a supporting member for a material layer in which are formed a heat generating element, ink flow paths, and ejection ports.

A plurality of ejection ports 14 are formed in the face of the orifice plate 12 that is opposite a printing medium. Further, the orifice plate 12, the flow path formation member 15, and the substrate 13 define a plurality of ink flow paths 16, which communicate with the individual ejection ports 14, and a common liquid chamber 17, in which ink supplied through the ink supply port 11 is stored and is distributed to the ink flow paths 16. Bubble generation chambers 19, which also serve as energy application chambers, are formed at the ends of the individual ink flow paths 16 on the side opposite the common liquid chamber 17. Furthermore, ink to be ejected is supplied by the ink supply path 11 to the bubble generation chambers 19 and is stored therein.

In addition, the print head 10 includes heat generating elements 18 that serve as ink ejection pressure generators. These heat generating elements 18 are arranged in two lines, at predetermined pitches. The heat generating elements 18 are disposed in the heat generation chambers 19 opposite the ejection ports 14. The heat generating elements 18 generate thermal energy, used for ink ejection, and apply the thermal energy to ink stored in the bubble generation chambers 19. The ejection ports 14 formed in the orifice plate 12 are positioned at locations corresponding to the heat generating elements 18 arranged on the substrate 13. That is, when heat is applied to ink by heat generating elements 18 and film boiling generates bubbles, kinetic energy is imparted to ink by the bubble pressure, and ink is ejected through the ejection ports 14. In this embodiment, the spacing intervals corresponding to that of the heat generating elements 18, at a pitch interval of 600 dpi, for one array, 384 ejection ports 14 are arranged in a zigzag manner, and for two arrays, a total of 768 ejection ports 14 are arranged.

Figure 4:
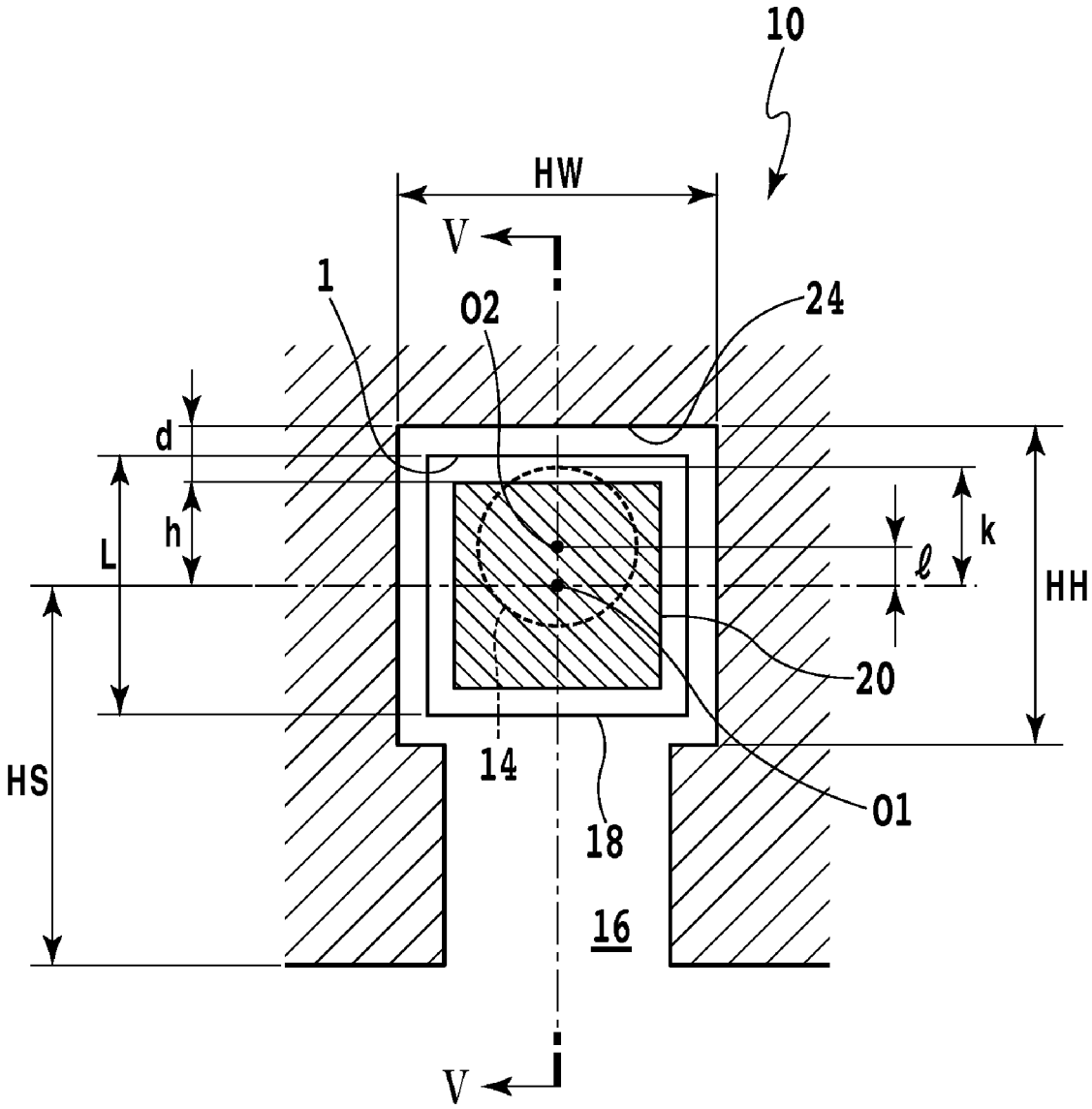
FIG. 4 is a cross sectional view of the print head taken along a line IV-IV in FIG. 3.
Figure 5:
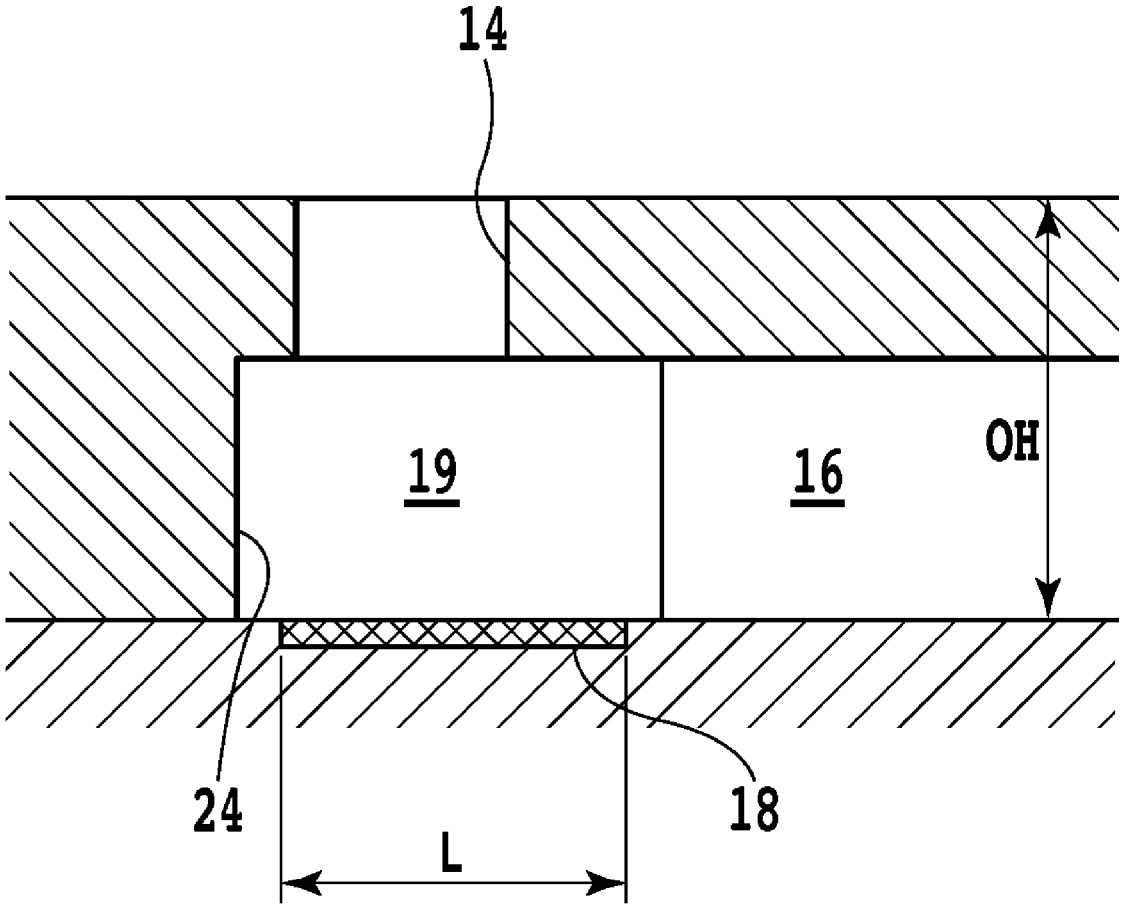
FIG. 5 is a cross sectional view of the print head taken along a line V-V in FIG. 4.

FIG. 4 is a plan view of an ink flow path 16 from the ink supply port 11, and FIG. 5 is a cross sectional view taken along a line V-V in FIG. 4. A length L of the heat generating element 18, in a direction leading from the ink supply port 11 toward the ejection port 14 is 21.2 μm, and a length perpendicular to this direction is 20.4 μm. The height of the ink flow path 16 is 16 μm. A height OH, from the bottom face of the ink flow path 16, on which the heat generating element 18 is arranged, to the ejection port face of the orifice plate 12, is 26 μm, and the diameter of each ejection port 14 is 13.5 μm. A width HW of the bubble generation chamber 19 is 25 μm, a length HH of the bubble generation chamber 19 is 26 μm, and a distance HS from the center of the heat generating element 18 to the leading end of the ink flow path 16 is 31 μm. The values of the physical properties of the ink used for this embodiment are: surface tension=32 dyn/cm, viscosity=3.0 cps and density=1.06 g/ml. It should be noted, however, that the ink used is not limited to one having the above described physical property values.

The ejection port 14 and the heat generating element 18 are arranged by shifting a center O2 of the ejection port 14 away from a center O1 of the heat generating element 18, in a direction in which ink is supplied to the heat generation chamber 19. In this embodiment, the center O2 of the ejection port 14 is shifted (offset) from the center O1 of the heat generating element 18 a distance of 3 μm to the rear of the heat generating element 19. The offset distance for the center O2 of the ejection port 14 from the center O1 of the heat generating element 18 is indicated by "l" in FIG. 4.

Further, the ejection port 14 is so positioned such that no contact is made with a rear end wall 24, which is the wall at the end of the bubble generation chamber 19 in the direction in which ink is supplied to the bubble generation chamber 19. With this arrangement, the entire area of the ejection port 14 communicates with the bubble generation chamber 19.

Figure 6:
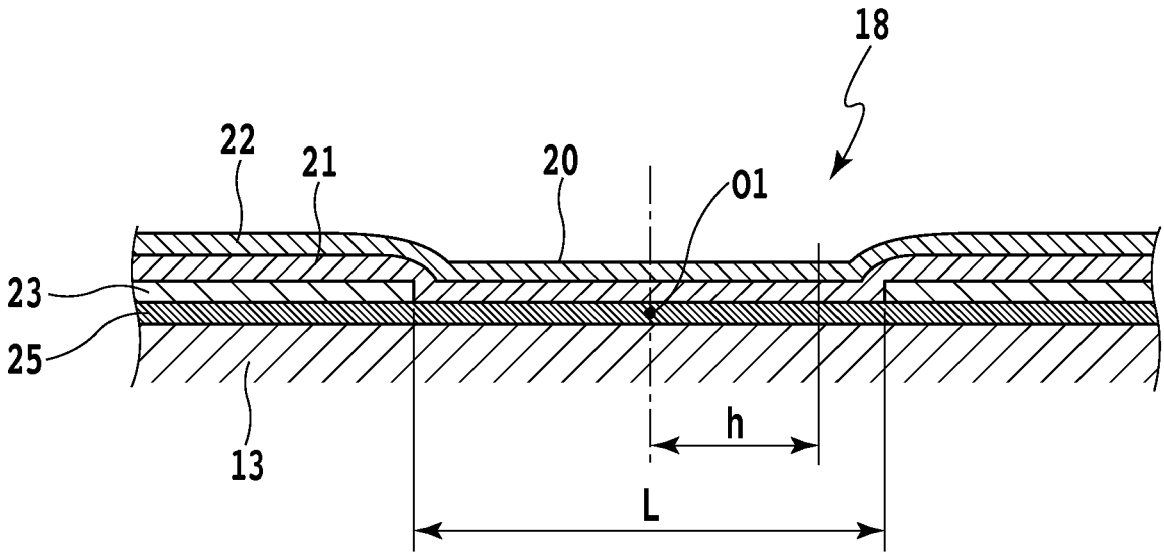
FIG. 6 is a cross sectional view of a heat generating element in FIG. 4.

In the process during which the heat generating element 18 is generating a bubble in the bubble generation chamber 19 for ink ejection, the entire area of the heat generating element 18 does not contribute to bubble generation. An effective bubbling area 20 of the heat generating element 18 that contributes to bubble generation will now be described. FIG. 6 is a cross sectional view of one of the heat generating elements 18 used for this embodiment. Since the heat generating element 18 is usually exposed in a severe environment wherein, for example, the temperature remarkably rises or falls within a short period of time, and moreover, wherein a mechanical shock is applied due to the occurrence of cavitation, which will be described later, the heat generating element 18 includes two protective layers 21 and 22 to protect its surface from the severe environment. That is, the protective layers 21 and 22, made of a mechanically stable metal such as tantalum (Ta), are formed on a heat generating element layer 25 that is on the side toward the common liquid chamber 17.

Aluminum (Al) wiring 23, for applying a current, is connected to the heat generating element 18. In the bubble generation chamber 19, in the periphery of the heat generating element 18, not all of the ink contacting the heat generating element 18 is bubbled. Since heat escapes around the periphery of the heat generating element 18 while being transferred through the protective layers 21 and 22 in the in-plane direction, or since heat is transmitted to the Al wiring 23 having a particularly high thermal conductivity, there is a peripheral portion of the heat generating element 18 where the temperature does not exceed the boiling point of ink. Therefore, the bubble is generated in an entire area of the heat generating element 18, but only in a portion where the temperature exceeds the boiling point of ink. Thus, the area in which the temperature exceeds the bubble boiling point and reaches the bubbling temperature, and thus contributes to bubble generation, is smaller than the entire area size of the heat generating element 18. The area in which a temperature exceeding the boiling point of ink is reached and is used for bubble generation is defined as the effective bubbling area 20.

In this embodiment, the ejection port 14 is partially, at least, located outside the effective bubbling area 20 of the heat generating element 18 that substantially contributes to the generation of a bubble B.

When a bubbling phenomenon of the heat generating element 18 of this embodiment was observed, it was found that the effective bubbling area 20 was smaller by 2 μm than the size of the heat generating element 18. Thus, for each bubbling area in this embodiment, a length in a direction leading from the ink supply port 11 to the ejection port 14 is 17.2 (=21.2−4.0) μm, while a length perpendicular to this direction is 16.4 (=20.4−4.0) μm. Further, while referring to FIG. 4, in a direction leading toward the rear end wall 24, a distance h from the center O1 of the heat generating element 18 to the edge of effective bubbling area 20 is 8.6 μm. An offset distance "l", which the center O2 of the ejection port 14 is shifted away from the center O1 of the heat generating element 18 toward the rear of the heat generation chamber 19, is 3 μm. Thus, a distance k from the center O1 of the heat generating element 18 to an end of ejection port 14, in a direction leading toward the rear of the bubble generation chamber 19, is 3+(13.5/2)=9.75 μm. In addition, in this embodiment, a distance d, from the rear end wall 24 of the bubble generation chamber 19, which is on the side farther from the ink supply port 11, to the rearward edge of the effective bubbling area 20 of the heat generating element 18, is 4.4 μm. Moreover, in this embodiment, the distance k, from the center O1 of the heat generating element 18 to the rearward end of the ejection port 14, is greater than the distance h, from the center O1 of the heat generating element 18 to the rearward edge of the effective bubbling area 20. The heat generating element 18 and the ejection port 14 are so arranged, in the above described positional relationship, so that the ejection port 14 projects rearward from the effective bubbling area 20.

The ink ejection operation of the print head 10 for this embodiment will now be described. FIGS. 7A to 7F are cross sectional views employed to explain the ink ejection processing performed for this embodiment. FIGS. 7A to 7F show the ink flow path 16 extending from the ink supply port, in accordance with the elapse of time.

Figure 7A:
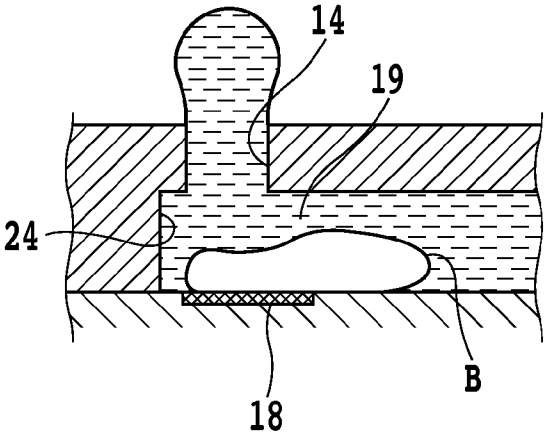
FIGS. 7A to 7F are diagrams for explaining ink ejection, as performed by the print head in FIG. 4.
Figure 7B:
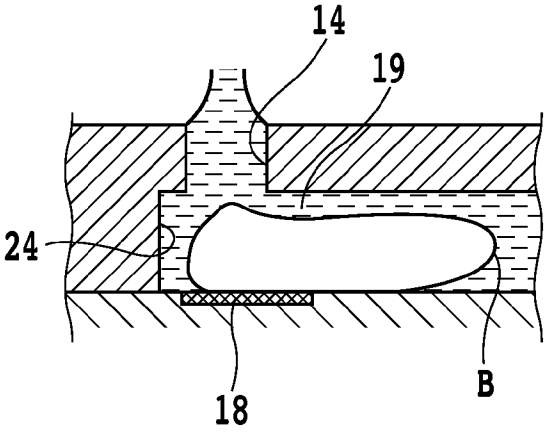
Figure 7C:
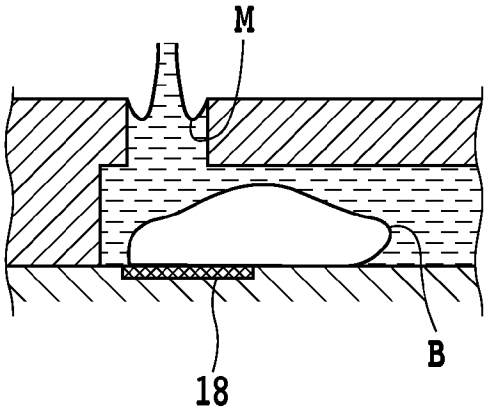

As shown in FIG. 7A, when ink is to be ejected through the ejection port 14, first, a current is applied to the heat generating element 18 to generate heat, and a bubble B is generated. At this step in the generation of the bubble B, the bubble B is generated only in the effective bubbling area 20 of the heat generating element 18. Then, as the bubble B grows, as shown in FIGS. 7A, 7B and 7C, ink is ejected by the bubble pressure, and the growth of the bubble B is halted when the maximum volume of the bubble B is reached. During the process performed to grow the bubble B, ink near the rear end wall 24 of the bubble generation chamber 19 is hard to be moved, since ink is located at near wall surface. Thus, the bubble B is hard to grow toward the rear end wall 24, and instead, the bubble grows toward the ink supply port 11. As a result, the shape of the bubble B is shortened in a direction leading from the heat generating element 18 to the rear end wall 24, and is lengthened along the ink flow path 16 in a direction leading to the ink supply port 11.

Figure 7D:
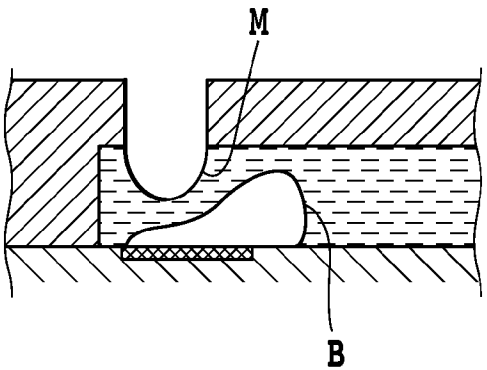

When the maximum volume of the bubble B is reached, as shown in FIG. 7C, the volume begins to be reduced. At almost the same time as reduction of that the volume is begun, the liquid surface becomes concave, along the circumference of the root of the liquid column of a main droplet to be ejected through the ejection port 14, and a meniscus M is formed on the surface of the liquid. Since the amount of ink is reduced in the bubble generation chamber 19 after ink is ejected, a backflow of ink is generated outside the ejection port 14, and the meniscus M is moved into the bubble generation chamber 19. The backflow of ink moves the meniscus M further toward the bubble generation chamber 19, until, as shown in FIG. 7D, the meniscus M enters the bubble generation chamber 19. Also, the bubble D is further deflated and the liquid surface of the meniscus moves nearer the bubble B. At this time, ink near the liquid surface of the meniscus M has been drawn inside the bubble generation chamber 19. Thus, as the meniscus M is moved, the bubble B and ink between the bubble B and the meniscus M are driven in the direction in which the meniscus M is moved, and a dent is formed in the bubble B. This speed at which the meniscus M moves is greater than that at which the bubble B is being deflated.

Figure 7E:
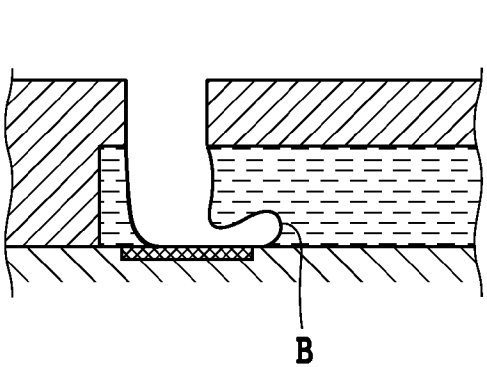
Figure 7F:
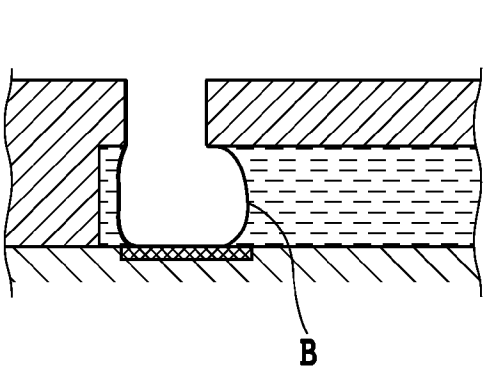

Following this, as shown in FIG. 7E, the meniscus M catches up with the bubble B, i.e., the liquid surface of the meniscus M moved into the bubble generation chamber 19 through the ejection port 14 contacts the bubble B, and the two are united. Therefore, air outside the meniscus M communicates with the bubble B. This embodiment uses an ink ejection method whereby the maximum volume of the bubble B is reached first, and when the volume is reduced, the bubble B to air communication is established. The location at which the bubble B to air communication is established is on the side opposite the ink supply port 11 at the center O1 of the heat generating element 18, i.e., the location is shifted toward the rear end wall 24. In the state shown in FIG. 7F, wherein bubble B to air communication continues, more ink is supplied to the bubble generation chamber 19, and the air inside the bubble B is externally discharged, through the ejection port 14. As a result, the bubble B disappears, and at this time, since the bubble B to air communication is maintained, the pressure in the bubble B is almost at the same level as that of the atmosphere.

In this embodiment, the ejection port 14 and the heat generating element 18 are so arranged that the end of the ejection port 14 toward the rear end wall 24 is located further to the rear than the effective bubbling area 20. Therefore, when the meniscus M and the bubble B are united, the bubble B does not communicate with the air at a location near the center O1 of the heat generating element 18, but at a location shifted away to the rear. That is, in this embodiment, the location at which the bubble B and the air communicate is shifted away from the center O1 of the heat generating element 18 in a direction leading toward the rear end wall 24 of the bubble generation chamber 19. Since the air communicates with the peripheral portion of the bubble B, it is difficult to separate the bubble B from the portion near to the rear end wall 24 and the portion near the ink supply port 11. As a result, cavitation conventionally caused by a portion separated from the bubble B can be prevented, and the durability of the print head 10 can be improved.

Second Embodiment

A print head 10', according to a second embodiment of the present invention, will now be described while referring to FIG. 8. However, for portions that can be provided in the same manner as in the first embodiment, no further explanation will be given, and reference numbers for like portions in the first embodiment will simply be provided. Only different portions will be fully described.

Figure 8:
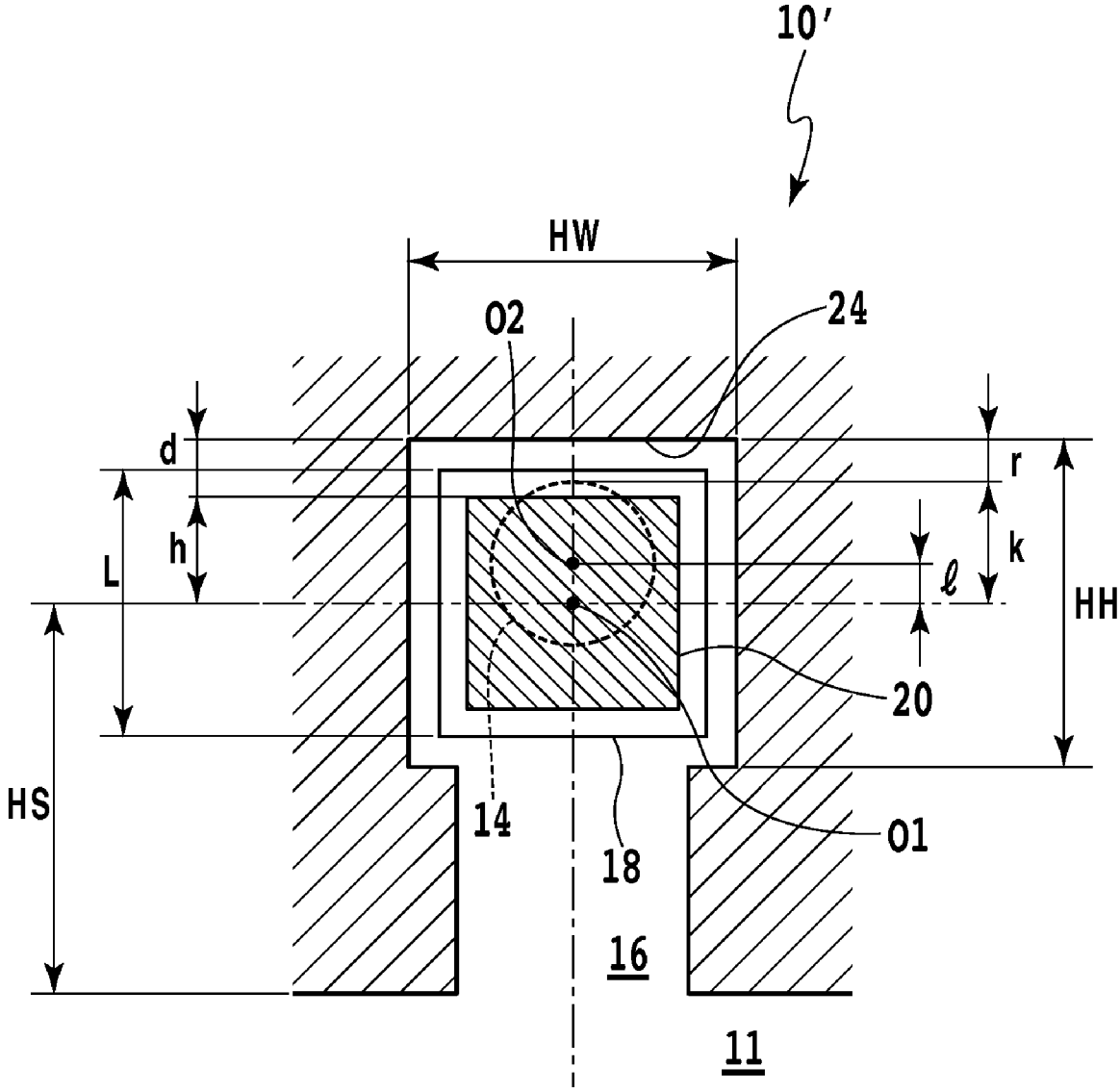
FIG. 8 is a cross sectional view of the essential portion of a print head according to a second embodiment of the present invention.

FIG. 8 is a plan view of an ink flow path 16 extended from an ink supply port 11 according to the second embodiment. As the size of a heat generating element 18, a length L, in a direction leading from the ink supply port 11 toward an ejection port 14, is 21.2 μm, and a length perpendicular to this direction is 20.4 m. The height of the ink flow path 16 is 16 μm. A height OH, measured from the bottom face of the ink flow path 16, on which the heat generating element 18 is arranged, to the ejection port face of an orifice plate 12, is 26 μm. The diameter of the ejection port 14 is 13.5 μm. For a bubble generation chamber 19, a width HW is 23 μm, a length HH is 23.2 μm, and a distance HS, from a center O1 of the heat generating element 18 to the ink supply port 11, is 31 μm. In the second embodiment, as in the first, a center O2 of the ejection port 14 is shifted away from the center O1 of the heat generating element 18, and is offset a distance "l" of 3 μm. The center O2 of the ejection port 14 is shifted away from the center O1 of the heat generating element 18 toward a rear end wall 24 of the bubble generation chamber 19.

In this embodiment, a distance d from the edge of an effective bubbling area 20 of the heat generating element 18, on the side farther from the ink supply port 11, to the rear end wall 24 is designated as 3.0 μm. According to the print head 10' of the second embodiment, although the distance d between the effective bubbling area 20 and the rear end wall 24 is shorter than that for the print head 10 of the first embodiment, a satisfactory distance d is still obtained.

Also in this embodiment, in order to shift the location at which a bubble to air communication is established, a distance k, from the center O1 of the heat generating element 18 to the rearward edge of the ejection port 14, is designated for which the length is greater than the distance h from the center O1 to the rearward edge of the effective bubbling area 20. According to this positional relationship for the print head 10' of this embodiment, the ejection port 14 projects toward the direction to rear wall from the effective bubbling area 20, and a distance d of 3.0 μm is obtained while maintaining this positional relationship. Therefore, with the arrangement wherein the ejection port 14 is offset from the heat generating element 18, an appropriate distance r is obtained that reaches from the rear edge of the ejection port 14 to the rear end wall 24. Thus, impeding the movement of ink near the face of the rear end wall 24 by friction against the wall 24 is inhibited. As a result, when a meniscus M is to be moved after ink is ejected through the ejection port 14, the movement of ink near the rear end wall 24 will not be blocked, so that deviation of the movement of the meniscus M can be avoided.

The ink ejection processing performed for the second embodiment will be studied by using a comparison example. An explanation will now be given for the comparison example used to perform a comparison with the print head 10' of the second embodiment.

FIGS. 9A to 9F are diagrams for explaining the ink ejection processing performed by a comparison example 1. A difference between a print head for the comparison example 1 and the print head 10' of the second embodiment is that a length HH of a bubble generation chamber 19 of the print head for the comparison example 1, in a direction leading from an ink supply port 11 to a rear end wall 24, is designated as 22.5 μm, which is shorter than that in the second embodiment. Further, a distance d from the rear end wall 24 to the rear edge of an effective bubbling area 20 is designated as 2.7 μm, which is also shorter.

Figure 9A:
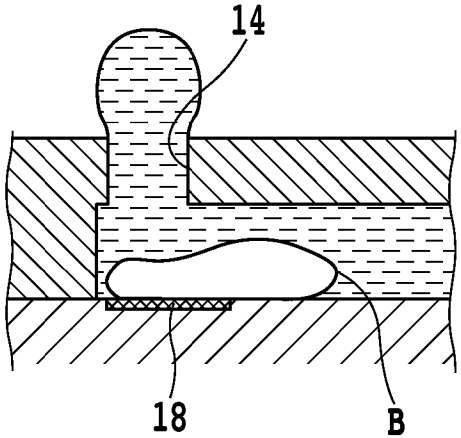
FIGS. 9A to 9F are diagrams for explaining ink ejection, as performed by a print head prepared as a comparison example 1.
Figure 9B:
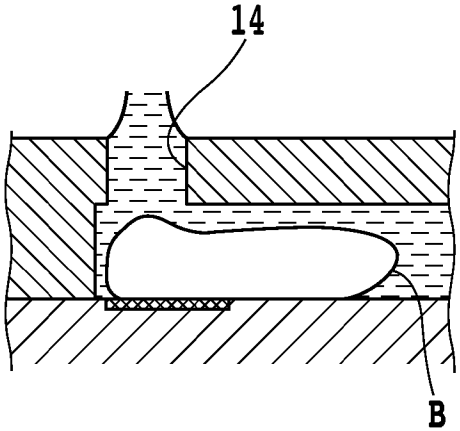
Figure 9C:
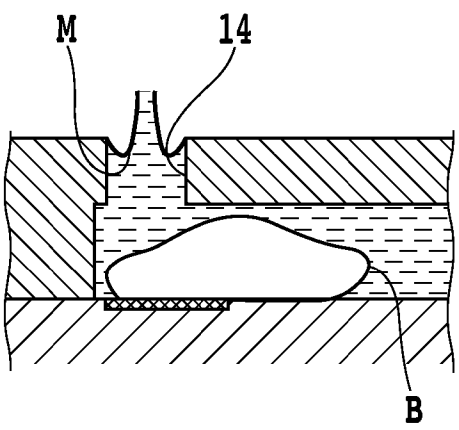
Figure 9D:
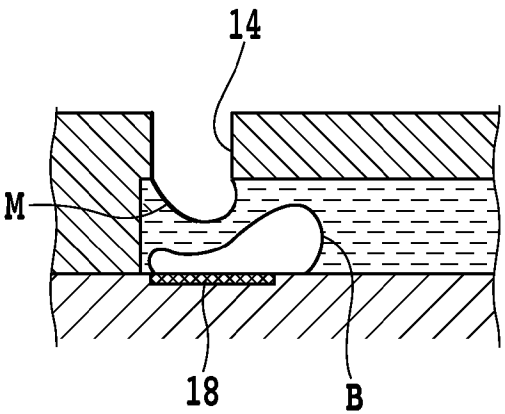

When a current applied to each heat generating element 18 is based, for example, on a print signal, as shown in FIG. 9A, a bubble B is generated on the heat generating element 18. At this time, the bubble B grows by sharply increasing its volume, and ink is ejected through an ejection port 14 by pressure generated by the bubble growth. Then, as shown in FIG. 9B, the maximum bubble is reached, and thereafter, as shown in FIG. 9C, the volume of the bubble begins to be reduced. Substantially at the same time, the liquid surface in the ejection port 14 is dented and the formation of a meniscus M is begun, and sequentially, thereafter, the meniscus M is moved toward the heat generating element 18. The processing up to this point is the same in the first and the second embodiments.

Figure 9E:
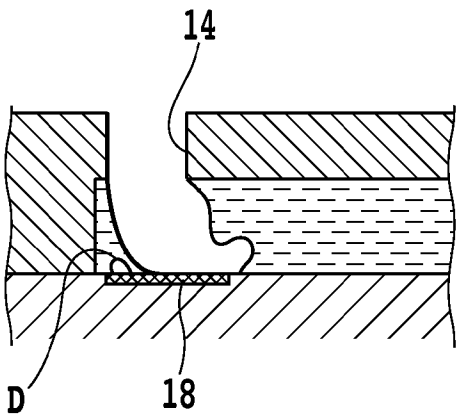
Figure 9F:
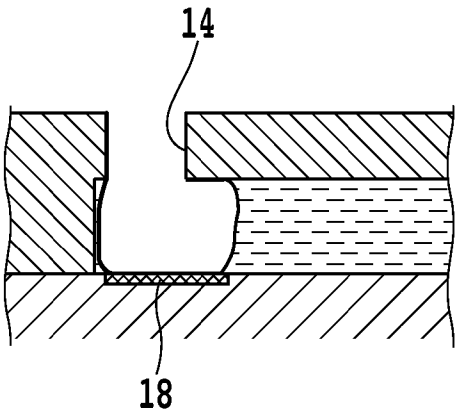

The meniscus M formed at the ejection port 14 is moved inside the bubble generation chamber 19. According to the comparison example 1, since a short distance d of 2.7 μm is designated from the rear end wall 24 to the rear edge of the effective bubbling area 20, the rear end of the ejection port 14 is located near the rear end wall 24. Therefore, friction is exerted on ink between near the rear end of the ejection port 14 and the rear end wall 24, so that ink in this portion is hard to move. Thus, the amount of movement of the meniscus M to the heat generating element 18 along a direction from the rear side of the bubble generation chamber 19 to the ink supply port 11, differs. As a result, too much of the growth of the meniscus M is on the ink supply port 11 side. Since too much meniscus M growth is on the ink supply port 11 side, even though a center O2 of the ejection port 14 is shifted from a center O1 of the heat generating element 18 toward the rear end wall 24, the effect thus obtained is offset, and the meniscus M and the bubble B communicate at a location near the center of the bubble B. As a result, the portion of the bubble near the center is annularly deformed and dented, and the probability that separation of the bubble B will occur is increased. Accordingly, the probability that cavitation will occur is also increased. In the comparison example 1, as shown in FIG. 9E, the bubble B is separated, and a bubble segment D remains in the bubble generation chamber 19. Since the bubble segment D continues to remain in the bubble generation chamber 19, by the time the bubble disappears, as shown in FIG. 9F, cavitation may have occurred. Further, when the bubble segment D collapses, a shock may be received by the faces of the surrounding walls, such as the heat generating element 18, and they may be damaged. As described above, according to the print head of the comparison example 1, since the distance d from the rear end wall 24 to the rear edge of the effective bubbling area 20 is too short, i.e., 2.7 μm, there is a probability that cavitation will occur and that the durability of the print head will be deteriorated.

An endurance test was performed by the print heads of the first and second embodiments and the comparison examples 1 and 2, and the results obtained are shown in Table 1. According to experiments performed to obtain the results in Table 1, the occurrence of cavitation was examined in accordance with the relative positions of the rear end wall 24 and the heat generating element 18. For the comparison example 2, a length HH of a bubble generation chamber 19 in a direction leading from an ink supply port 11 to a rear end wall 24, is designated as 22.0 μm, which is much shorter than that in the comparison example 1. Accordingly, a distance d from the rear end wall 24 to the rear edge of an effective bubbling area 20 is designated as 2.4 μm, which is also a much shorter distance.

TABLE 1

| | First Embodiment | Second Embodiment | Comparison Example 1 | Comparison Example 2 |
|---|---|---|---|---|
| Length HH [μm] of bubble generation chamber | 26.0 | 23.2 | 22.6 | 22.0 |
| Length L [μm] of heat generating element | 21.2 | 21.2 | 21.2 | 21.2 |
| Length [μm] of effective bubbling area | 17.2 | 17.2 | 17.2 | 17.2 |
| Distance d [μm] from rear end wall to rear edge of effective bubbling area | 4.4 | 3.0 | 2.7 | 2.4 |
| Cavitation damage | No | No | Yes | Yes |

In the first embodiment, the distance d from the rear end wall 24 to the rear edge of the effective bubbling area 20 is 4.4 μm, and in the second embodiment, the distance d is 3.0 μm. Furthermore, in the comparison example 1, the distance d is 2.7 μm and in the comparison example 2, the distance d is 2.4 μm. According to the result of the endurance test, the occurrence of cavitation was observed in the comparison examples 1 and 2, while for the print heads of the first and second embodiment, the occurrence of cavitation was not observed.

Based on the experiment results, 3 μm or greater is regarded as an effective distance d from the rear end wall 24 of the bubble generation chamber 19 to the edge of the effective bubbling area 20 of the heat generating element 18, which is farther from the ink supply port 11. When 3 μm or greater is designated as the distance d from the rear end wall 24 to the rear edge of the effective bubbling area 20, the meniscus M can be shaped with less deviation toward the ink supply port 11, and separation of a bubble can be prevented. Therefore, the occurrence of a cavitation can be avoided, and the durability of the print head can be improved.

Third Embodiment

A print head 10" of a third embodiment of the present invention will now be described. However, for portions that can be provided in the same manner as in the first or second embodiments, no further explanation will be given, and reference numbers for like portions in the first or second embodiment will simply be provided. Only different portions will be fully described.

Figure 10:
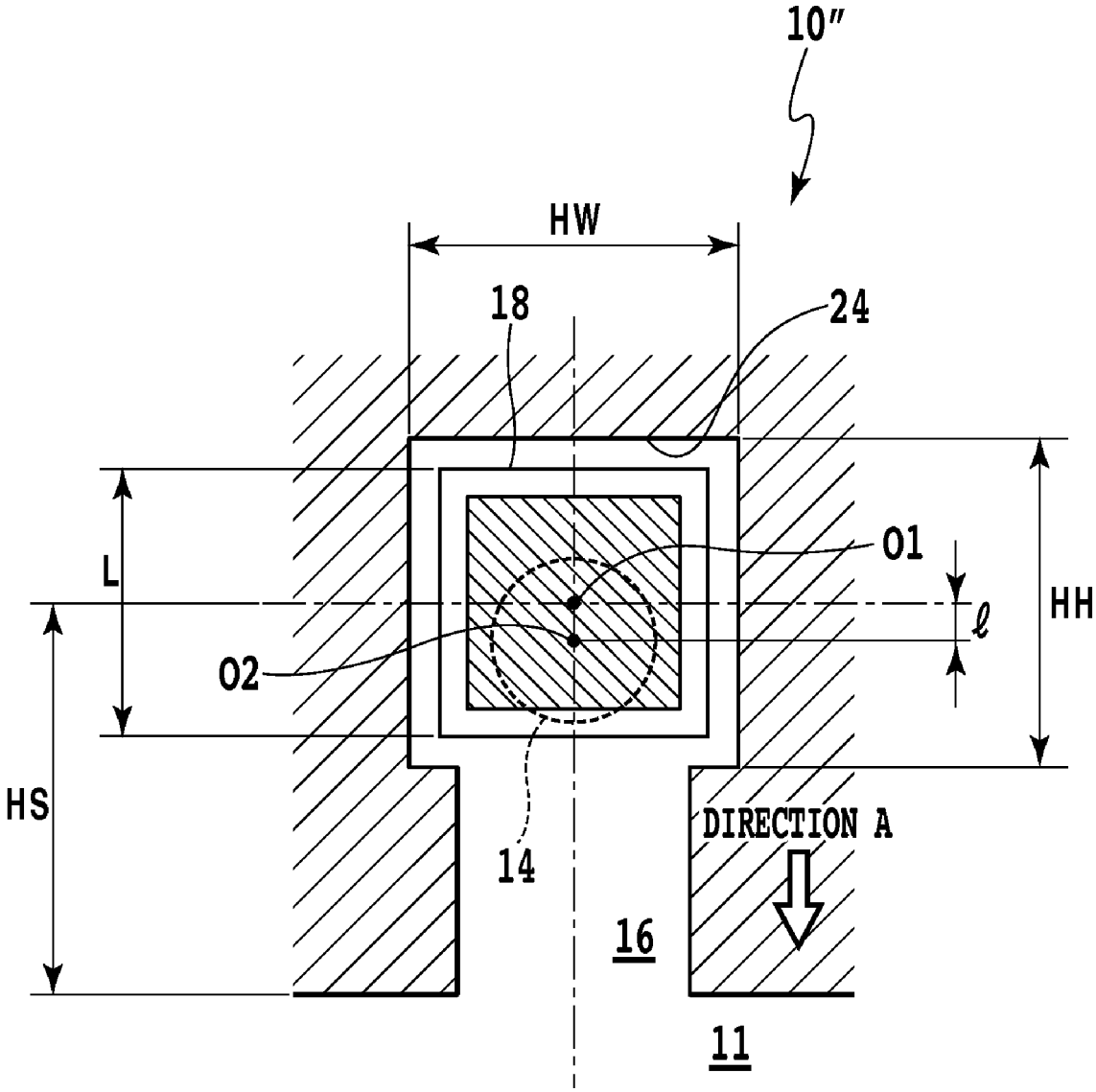
FIG. 10 is a cross sectional view of the essential portion of a print head according to a third embodiment of the present invention.

FIG. 10 is a plan view of an ink flow path 16 extended from an ink supply port 11 according to the third embodiment. A length L of a heat generating element 18 in a direction leading from the ink supply port 11 toward an ejection port 14 is 21.2 μm, and the perpendicular length to this direction is 20.4 μm. The height of the ink flow path 16 is 16 μm. A height OH, measured from the bottom face of the ink flow path 16 on which the heat generating element 18 is arranged to the ejection port face of an orifice plate 12, is 26 μm, and the diameter of each ejection port 14 is 13.5 μm. A width HW of each bubble generation chamber 19 is 25 μm and a length HH is 26 μm, and a distance HS, from the center O1 of the heat generating element 18 to the leading end of the ink flow path 16, is 31 μm. In this embodiment, the ejection port 14 and the heat generating element 18 are arranged so that the center O2 of the ejection port 14 is shifted toward the ink supply port 11 (i.e., a direction indicated by an arrow A in FIG. 10), from the center O1 of the heat generating element 18 in an opposite direction in which ink is supplied to the heat generation chamber 19. The offset distance "l" is 3 μm. In the print head 10' for the second embodiment, the center O2 of the ejection port 14 is shifted away from the center O1 of the heat generating element 18 toward the rear end wall 24. A difference between the print head 10" for the third embodiment from the print head 10' for the second embodiment is that the center O2 of the ejection port 14 is shifted away from the center O1 of the heat generating element 18, not toward the rear end wall 24 but toward the ink supply port 11, in this embodiment.

Further, the ejection port 14 is located so that there is no contact with the wall faces of the bubble generation chamber 19. With this arrangement, the entire area of the ejection port 14 communicates with the bubble generation chamber 19. Generally, a wall is not formed for the bubble generation chamber 19 on the ink supply port 11 side. However, there is also a print head wherein a channel between the ink supply port 11 and the bubble generation chamber 19 is narrowed in accordance with the shape of the ink flow path 16. In a case involving such a print head, there is a possibility that when the ejection port 14 is shifted toward the ink supply port 11, the ejection port 14 will contact the face of the wall that partitions the ink flow path 16. Therefore, in order to avoid such a problem, the ejection ports 14 are arranged so that the ejection ports do not contact the wall faces of the bubble generation chambers 19, and the entire area of the ejection ports 14 communicates with the bubble generation chambers 19.

The ink ejection processing performed using the print head 10" of the third embodiment will be described. FIGS. 11A to 11F are diagrams for explaining the ink ejection processing performed by the print head 10" of the third embodiment.

Figure 11A:
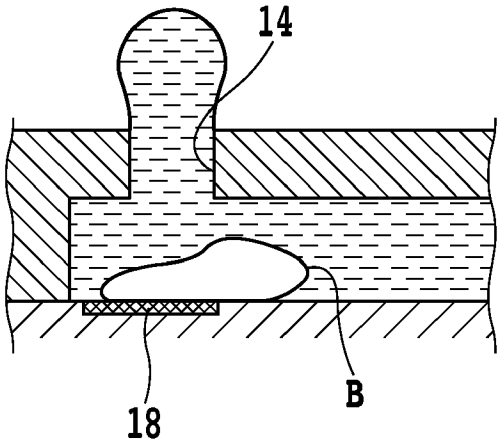
FIGS. 11A to 11F are diagrams for explaining ink ejection, as performed by the print head in FIG. 10.
Figure 11B:
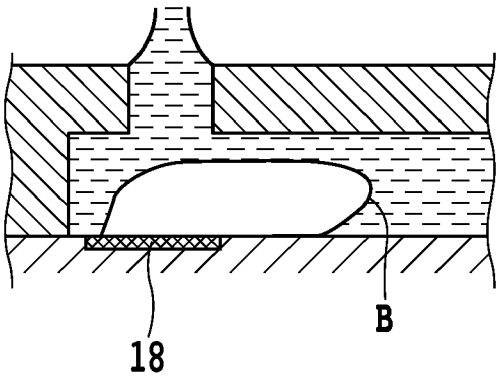
Figure 11C:
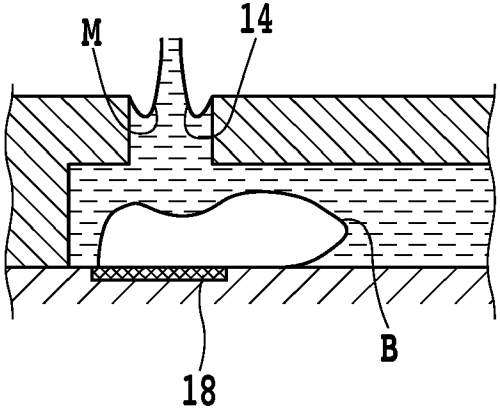
Figure 11D:
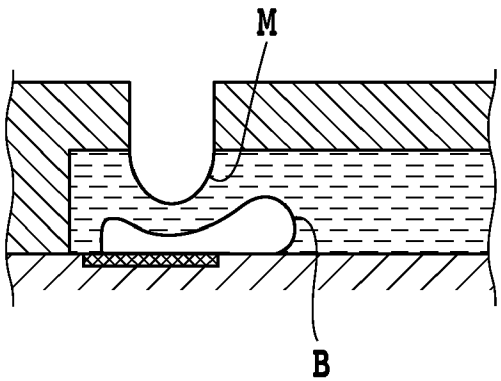

When a current is applied to each heat generating element 18 based, for example, on a print signal, as shown in FIG. 11A, a bubble B is generated on the heat generating element 18. At this time, the bubble B growing in volume is sharply increased, and ink is ejected through the ejection port 14 by the bubble pressure generated by the bubble growth. Then, as shown in FIG. 11B, the maximum bubble B volume is reached, and thereafter, as shown in FIG. 11C, the volume begins to reduce. Substantially at the same time, the liquid surface in the ejection port 14 is dented and formation of a meniscus M is begun, and sequentially, thereafter, the meniscus M is moved toward the heat generating element 18. The processing up to this point is the same as that in the first and the second embodiments.

Figure 11E:
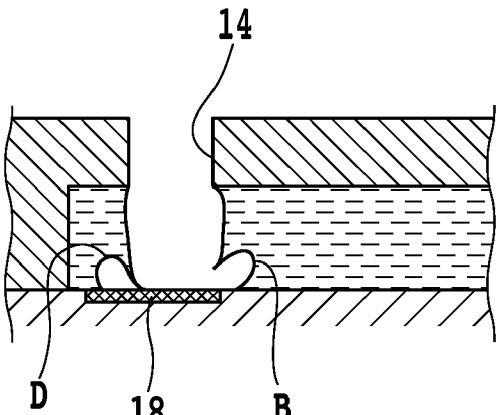

Sequentially, as shown in FIG. 1D, the meniscus M is moved toward the heat generating element 18 and ink between the meniscus M and the bubble B is drawn in toward the heat generating element 18. As a result, the portion of the bubble B near the meniscus M is dented, toward the heat generating element 18, and the bubble B is deformed. At this time, since the portion of the bubble B near the center will communicate with the air, the center portion of the bubble B is dented till shaped like a ring and is greatly deformed, and sequentially, thereafter, deformation of the bubble B is advanced, and the meniscus M that has been moved from the ejection port 14 into the bubble generation chamber 19 contacts the bubble B and the two are united. Therefore, the bubble B and the air communicate with each other. In this embodiment, when the bubble B and the meniscus M are united and communicate with each other, the bubble B is separated as shown in FIG. 11E.

Figure 11F:
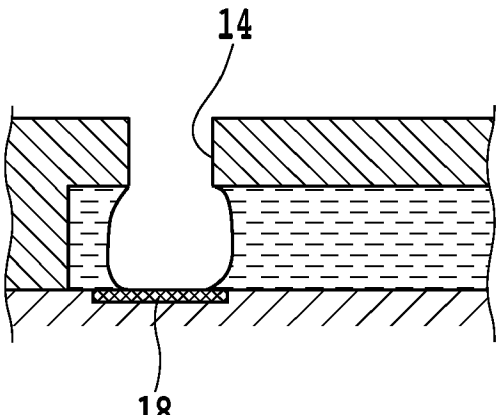
Figure 12A:
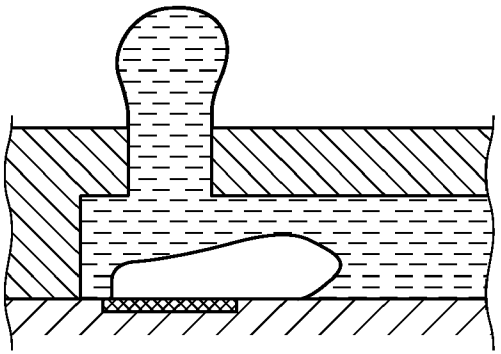
FIGS. 12A to 12F are diagrams for explaining ink ejection, as performed by a conventional print head.
Figure 12B:
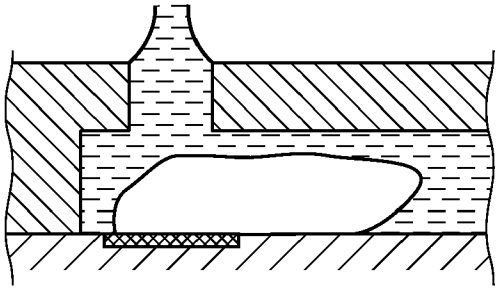
Figure 12C:
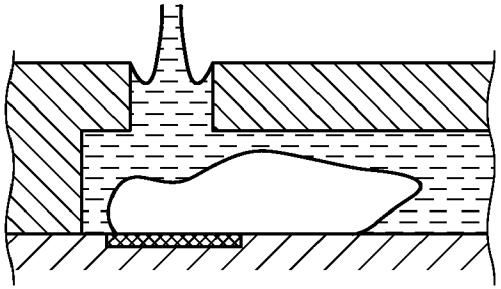
Figure 12D:
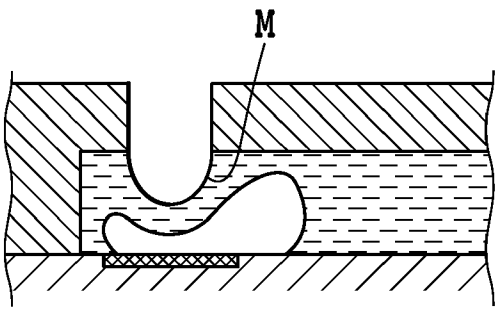
Figure 12E:
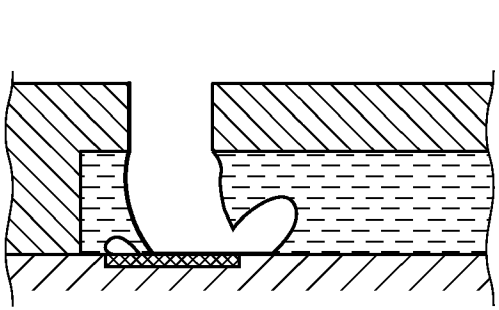
Figure 12F:
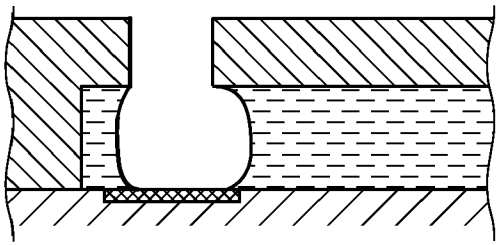

In this embodiment, since the center O2 of the ejection port 14 is shifted from the center O1 of the heat generating element 18 toward the ink supply port 11, the bubble B communicates with air at a location nearer the ink supply port 11 than the center O1 of the heat generating element 18. Thus, the portion of the bubble B that communicates with air is nearer the center of the bubble B than is the case for either of the print heads used for the first and the second embodiments, and for a conventional print head. Therefore, when the bubble B is to communicate with air, the bubble B is greatly dented and separated. A bubble segment D obtained by the separation is larger than the bubble segment obtained not only for the print head of the first and second embodiments but also for the conventional print head. Therefore, the separated bubble portion temporarily remains as the bubble segment D in the bubble generation chamber 19; however, since this bubble segment D is quite large, it takes an appropriately long time for the bubble D to disappear. Therefore, before the bubble segment D disappears, the bubble segment D can be united with the meniscus M and communicate with air. In this embodiment, since the bubble segment D was present and held its size when the bubble B was to communicate with air, as shown in FIG. 11F, when the bubble segment D disappears, the occurrence of cavitation is inhibited. In this manner, a period lasting until the bubble disappears is extended by increasing the size of the bubble segment D, and the segment bubble D is permitted to communicate with the air. As a result, the occurrence of cavitation can be prevented, and accordingly, the durability of the print head 10" can be increased.

Table 2 shows the results obtained by observing an offset distance "l" from the center O2 of the ejection port 14 to the center O1 of the heat generating element 18, and the occurrence of cavitation. In Table 2, the print head 10" of the third embodiment is compared with comparison examples 3, 4 and 5. The comparison examples 3, 4 and 5 will now be described. Differences between the print head 10" of the third embodiment and print heads of the comparison examples 3, 4 and 5 are the offset distance "l" from the center O2 of the ejection port 14 to the center O1 of the heat generating element and the length HH of the bubble generation chamber 19. The offset distance "l" is 1.0 μm for the comparison example 3, 0 for the comparison example 4 and 0.5 μm for the comparison example 5. The length HH of the bubble generation chamber 19 is 25.0 μm for the comparison example 3, 22.5 μm for the comparison example 4 and 22.0 μm for the comparison example 5.

The study results of Table 2 will now be described. In the comparison example 3, wherein the center O2 of the ejection port 14 is shifted toward the ink supply port 11 a distance of 1.0 μm, no cavitation occurred, while in the comparison example 4, wherein the center O2 of the ejection port 14 matches the center O1 of the heat generating element 18, cavitation occurred. Also in the comparison example 5, wherein the center O2 of the ejection port 14 is shifted away from the center O1 of the heat generating element 18 toward the ink supply port 11 a distance of 0.5 μm, cavitation occurred.

Based on these results, in the comparison example 3, wherein the ejection port center O2 is shifted toward the ink supply port 11 a distance of 1.0 μm, since the segment bubble D grows considerably large, a long time can elapse before the bubble segment D communicates with the air. Thus, when 1.0 μm is set as the offset distance "l", a bubble segment D having a satisfactorily large size can be obtained for communicating with the air.

In the comparison example 4, wherein the center O2 of the ejection port 14 matches the center O1 of the heat generating element 18, the bubble segment D was not satisfactory large and disappeared before it could communicate with the air. Therefore, the bubble segment D collapsed without communicating with the air, and at this time, would have damaged the surface of the heat generating element 18. Actually, according to the test results for the comparison example 4 shown in Table 2, cavitation damage was found.

Cavitation damage was also found in the comparison example 5, wherein the offset distance "l" from the center O2 of the ejection port 14 to the center O1 of the heat generating element 18 was 0.5 μm. From these results, it is apparent that even if the center O2 of the ejection port 14 is shifted to the center O1 of the heat generating element 18 and toward the ink supply port 11, the offset distance "l" of 0.5 μm is unsatisfactory and cavitation occurs. When the offset distance "l" is 0.5 μm or shorter, the size of the bubble segment D is not sufficiently large, and before communicating with the air, the bubble segment D collapses and would apply a shock to the peripheral wall faces.

As described above, when the offset distance "l", from the center O2 of the ejection port 14 to the center O1 of the heat generating element 18, is 1 μm or greater, an appropriately large bubble segment D is obtained that can easily communicate with the air, so that the occurrence of cavitation is suppressed. Therefore, damage to the wall faces of the print head is prevented, and the durability of the print head can be improved.

TABLE 2

| | Third Embodiment | Comparison Example 3 | Comparison Example 4 | Comparison Example 5 |
|---|---|---|---|---|
| Length HH [μm] of bubble generation chamber | 26.0 | 25.0 | 22.5 | 22.0 |
| Length L [μm] of heat generating element | 21.2 | 21.2 | 21.2 | 21.2 |
| Offset "1" [μm] from center O2 of ejection port to center O1 of heat generating element | 3.0 | 1.0 | 0.0 | 0.5 |
| Cavitation damage | No | No | Yes | Yes |

Other Embodiments

The liquid ejection head of this invention can be mounted on an apparatus such as a printer, a copier, a facsimile machine including a communication system, or a word processor including a printer unit, or on an industrial printing apparatus that provides multifunctions in concert with various other processors. By using the liquid ejection head, printing can be performed on various types of recording media, such as paper, yarn, fiber, textile, leather, metal, plastic, glass, wood and ceramics. It should be noted that "printing" used in this specification represents not only the application of an image having a meaning, such as a character or a figure, to a printing medium, but also the application of an image having no meaning, such as a pattern.

Furthermore, "ink" or a "liquid" should be widely interpreted, i.e., should be a liquid that is applied to a recording medium in order to form an image, a design or a pattern, or to process ink or a recording medium. The process for ink or a recording medium is, for example, coagulation of the coloring material of ink to be applied to a recording medium, or change of this coloring material into an insoluble form, so as to obtain improved fixation, improved printing quality and color development and improved image durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-077543, filed Mar. 23, 2007, which is hereby incorporated by reference herein in its entirety.

What is claimed is:

1. A liquid ejection head comprising:

a substrate including a heat generating element configured to generate thermal energy to be used for ejecting liquid;

a liquid supply port supplying liquid to the heat generating element and penetrating the substrate;

an ejection port through which liquid is ejected and formed so as to be opposed to the heat generating element;

an energy application chamber including the heat generating element internally; and a liquid flow path in which the liquid supply port and the energy application chamber are in communication with each other therethrough, wherein the liquid is ejected by generating a bubble by the thermal energy, wherein the bubble grows till the maximum volume is attained, and then when a volume reduction step begins, the bubble communicates with the air, and wherein the ejection port and the heat generating element are arranged so that the center of the ejection port is shifted away from the center of the heat generating element in a direction from the liquid supply port toward the energy application chamber, and a part of a perimeter of an opening, on the energy application chamber side of an ejection port, is located between an edge of an effective bubbling area of the heat generating element that contributes to generation of the bubble and a rear wall of the energy application chamber at the end of the direction.

2. A liquid ejection head according to claim 1, wherein the ejection port is arranged such that contact is not made with the rear wall of the energy application chamber at the end of the direction, and the entire area of the ejection port communicates with the energy application chamber.

* * * * *